United States Patent [19]

James et al.

[11] 3,998,029

[45] Dec. 21, 1976

[54] TOWER CRANE CLIMBING

[76] Inventors: Arthur M. James, 2475 NW. 158th, Beaverton, Oreg. 97005; Charles J. Conlee, 6938 SW. 8th, Portland, Oreg. 97219

[22] Filed: July 11, 1975

[21] Appl. No.: 595,072

[52] U.S. Cl. ..... 52/747; 52/115; 52/122; 212/57

[51] Int. Cl.[2] ..... E04H 12/34

[58] Field of Search ..... 52/122, 123, 115, 126, 52/747; 212/57; 214/1 H; 254/139

[56] References Cited

UNITED STATES PATENTS

| | | | |
|---|---|---|---|
| 3,413,767 | 12/1968 | Wilson | 52/115 |
| 3,464,169 | 9/1969 | Potain | 52/126 X |

*Primary Examiner*—J. Karl Bell

*Attorney, Agent, or Firm*—Kolisch, Hartwell, Dickinson & Stuart

[57] ABSTRACT

A tower crane and method of climbing the crane. The tower of the crane is initially stabilized at an elevated location, and the tower is released from a base frame supporting its base and elevated to place its base on an upper frame, the base frame is then elevated, and the tower is then dropped to place it on the newly positioned base frame with the upper frame then used to laterally stabilize the tower with the crane in operative condition.

12 Claims, 9 Drawing Figures

TOWER CRANE CLIMBING

This invention in general relates to so-called tower cranes, and more particularly, to a means and method for elevating a tower crane to compensate for the increase in height which takes place in a building as the building progresses.

So-called tower cranes are known which in operative position include an elongate mast, or tower, projecting upwardly from the top of the building under construction, and a crane with boom rotatably mounted on the top of the tower used in elevating and otherwise handling the materials going into the construction of the building. As construction progresses, it is necessary from time to time to elevate the tower of the crane to compensate for the additions in height made to the building as a result of the construction. The crane when made ready for the handling of loads obviously must be securely braced with respect to the building, so as properly to withstand lateral and vertical loading. Furthermore, during elevating, or "climbing," of the crane, the tower of the crane obviously must be stabilized to withstand loading which is the result, for instance, of wind, and the fact that the crane itself frequently is used in performing the climbing process.

Tower cranes adapted to be elevated as the construction of a building progresses, sometimes referred to as "climbing" cranes, as have been proposed in the past, have been subject to a number of disadvantages. In one known form of construction, multiple frames are utilized which support the tower in the crane at points along its length, and the climbing operation is performed with "leapfrogging" of the lower of these frames above the remainder. With such an approach, the lowermost frame or platform which is subjected to the leapfrogging must be dismantled and then reassembled at a new location above the other frames, each time a climb is made. This has proven to be a very time consuming process, particularly when it is remembered that usually such a platform must be moved to the outside of the building to accommodate its upward positioning in the construction. The approach has also required that each of the frames or platforms have a rugged construction, since as successive climbs are made, each frame or platform at one time or another serves as the main support for the base of the tower. Other types of cranes have been subject to other disadvantages, such as suffering limitations with respect to the type of building with which they may be used, or requiring powered means for producing lifting of the crane of a complicated and expensive nature.

A general object of the invention, therefore, is to provide a unique method of climbing a tower crane, which may be performed relatively rapidly with minimum down time at the construction site.

Another object is the provision of a method of climbing a tower crane, which includes shifting frames or platforms along the length of the tower in the crane, with the base frame or platform always providing the principal support for the base of the tower after such has been relocated.

Another object is the provision of a climbing method wherein, during climbing, the tower climbs ladder structure depending from what is termed herein as an upper frame in the construction, after detachment of the tower from what is termed herein a base frame, the base frame then being elevated to a new location in the building, and after being secured in this position, receiving the base of the tower which is then lowered onto it.

Utilizing the method contemplated, the tower in the crane is adequately stabilized during the climbing operation to withstand the loading to which it is subjected during climbing. When finally positioned after a climb, the tower is then fully braced, to permit maximum loading, by frames or platforms located at different floor levels in the building.

These and various other objects, features and advantages of the invention will become more fully apparent from a reading of the following description, which is to be taken in conjunction with the accompanying drawings, wherein.

Figure 1:
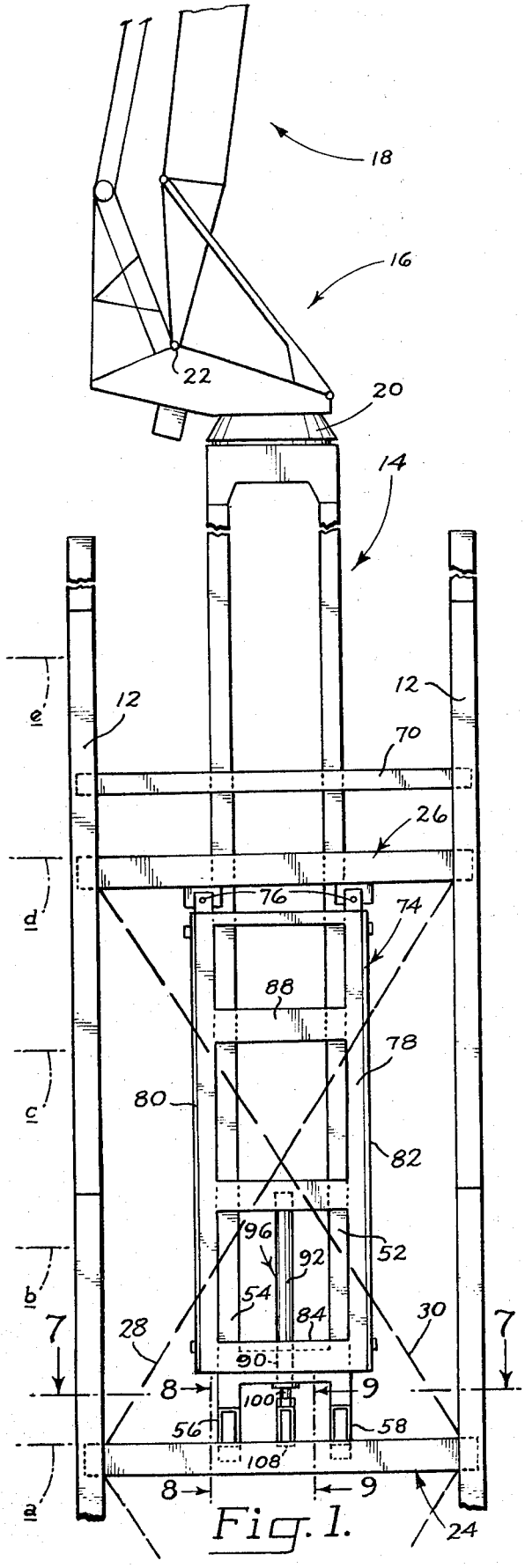
FIG. 1 is a view, in somewhat simplified form, illustrating portions of a bay in a building under construction, with a tower crane adapted for climbing supported within such bay, and showing the crane with the tower thereof fully stabilized in an operative condition, whereby the crane may be subjected to full loading.

Referring now to the drawings, and more particularly to FIG. 1, illustrated are two of the four columns 12 which in a typical building are found at each of the four corners of a bay in the building. Floor levels in the building under construction are indicated by dot-dashed lines spaced vertically at regular modules along the columns 12. In FIG. 1, five floors are shown, indicated by the reference letters *a*, *b*, *c*, *d* and *e*, respectively. The structure forming these floors is suitably joined to the columns defining the four corners of the bay. Disposed within this bay, and projecting upwardly from the top of the building under construction, is a tower or mast 14 of a tower crane generally depicted at 16. In a typical instance, the bay which receives this tower is one that might be utilized for elevator shafts in the building, with the bay, therefore, being left open as floors are added to the building.

Tower crane 16 includes an elongate boom 18 supported on the top of the tower 14 through rotating structure 20 which accommodates swiveling of the boom about a vertical axis. The boom itself may be lowered from the upright position shown to assume a more horizontal placement, with such swinging about an axis 22. In the usual instance, the boom, as well as the tower or mast 14, is a truss type structure, comprising a number of members interconnected to form a rigid skeletal framework. For reasons of simplicity, much of the truss structure in the boom and tower has been eliminated.

In FIG. 1, the tower of the crane is shown supported within the bay defined by columns 12 in an operative condition, with the crane readied for the handling of loads. Specifically, the base of the tower rests on what is referred to herein as a base frame or platform 24 which is suitably secured in place at the level of floor *a*. With this frame at a floor level, maximum lateral stability is imparted to the frame, by reason of the rigidity introduced by the surrounding floor structure. Supporting the tower at a location disposed above the base frame is what is referred to herein as an upper frame or platform 26. This frame is secured in place to the columns at the location of floor *d*. Again, by reason of the location of the frame at a floor level, maximum lateral stability is imparted to the frame. In order further to strengthen the bay, guy lines such as those shown at 28 and 30 extending diagonally between the frames 24, 26 may be provided, at each of the four sides of the bay defined by the columns 12.

Figure 7:
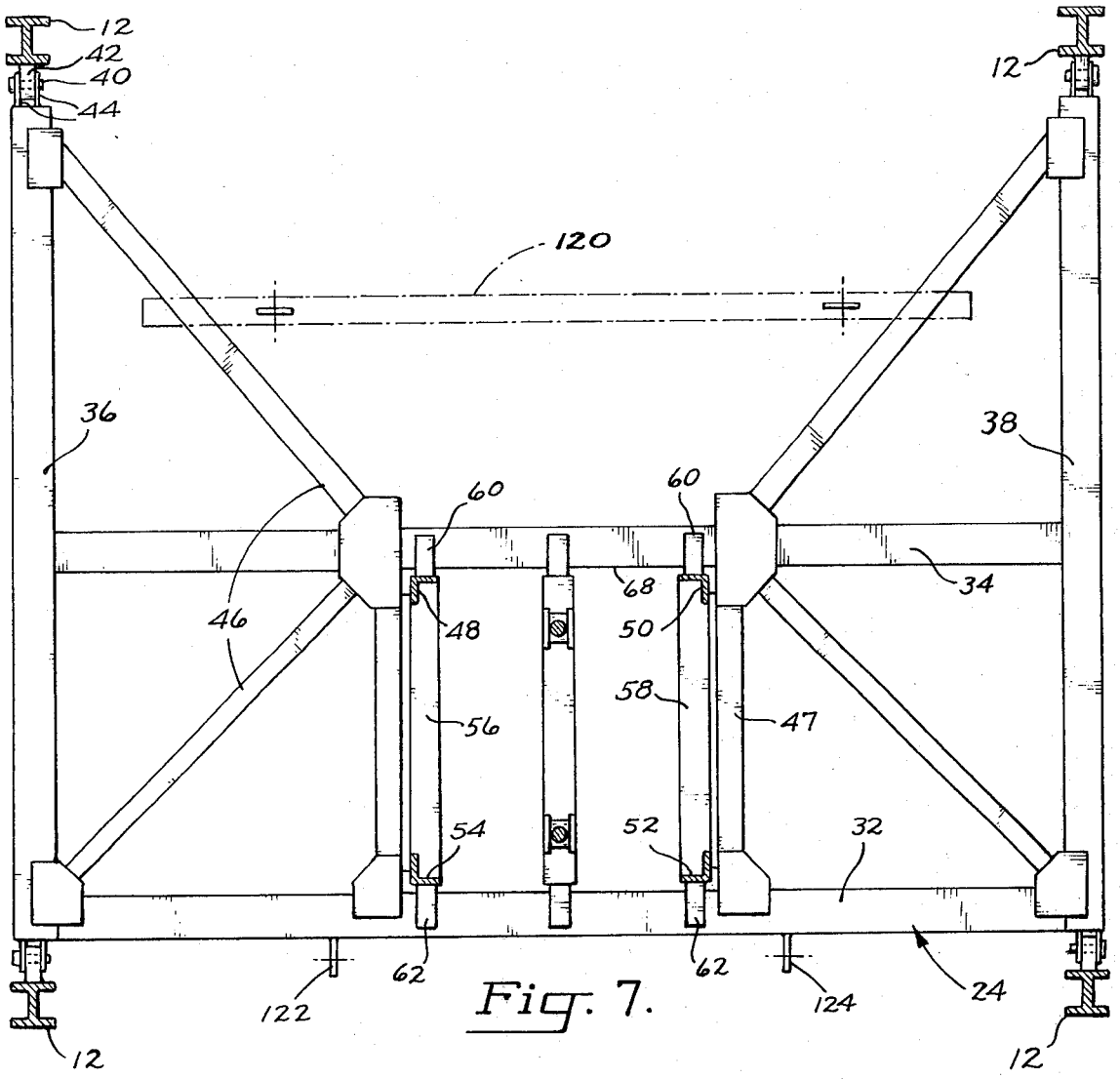
FIG. 7 is a plan view showing the base frame in the organization.

Referring momentarily to FIG. 7, which illustrates in greater detail the construction of frame or platform 24, such includes main support beams 32, 34 having ends rigidly joined to transversely extending cross beams 36, 38. Each end of cross beam 36 is detachably secured to a column 12 on one side of the bay by a detachable fastening assembly including pin 40 extending through aligned bores provided in a bracket 42 secured to the column and spaced opposed bracket plates 44 secured to the end of the cross beam. A similar construction is utilized in joining the ends of cross beam 38 to beams 12 on the opposite side of the bay. The platform further includes struts 46 and braces 47 suitably joined to the various beams making the platform completely rigid.

Figure 8:
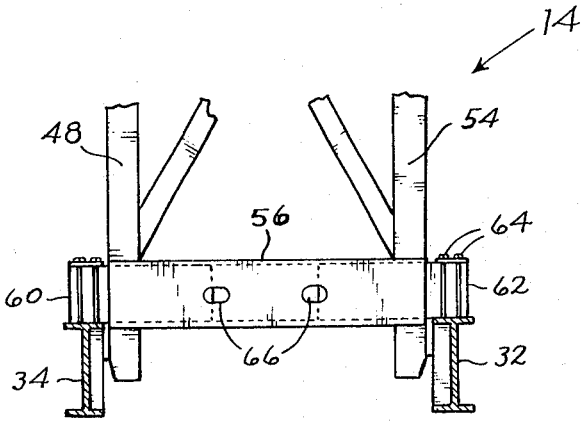
FIG. 8 is a view taken generally along the line 8—8 in FIG. 1.

As perhaps best illustrated in FIGS. 7 and 8, tower or mast 14 includes at each of the four corners thereof verticals shown at 48, 50, 52 and 54. Spanning the bottom ends of uprights 48, 54 and secured thereto is a rigid sleeve 56, and a similar sleeve 58 spans the ends of uprights 50, 52. Each of these sleeves includes, and reference is made to sleeve 56 shown in FIG. 8, a pair of outriggers 60, 62, with one telescopically received within each of the opposite ends of the sleeve. With the base of the tower operatively secured to base frame 24, the various outriggers are detachably secured to beams 32, 34 of the frame, as with detachable fasteners shown at 64.

Braces 47 and midregions of cross beams 36, 38 define an opening 68 of generally rectangular outline, which opening has a somewhat larger size than the rectangular outline of the tower or mast (with outriggers 60, 62 contracted into the sleeves mounting them). As a consequence, with detachment of the outriggers from beams 34, 32, and with retraction of the outriggers (utilizing conventional iron workers levering tools and employing access ports 66 provided in the sleeves) the construction permits relative axial displacement of the frame upwardly on the base of the tower.

As already explained, an upper frame or platform 26 is provided at floor level *d*. Such may have a construction similar to base frame 24, the construction differing primarily in that such may be of lighter mass than base frame 24 as the upper frame braces the tower primarily from lateral loading and is not ordinarily utilized to support the base of the tower other than at a stage in the climbing operation. With the tower crane in operative position as shown in FIG. 1, suitable shims are provided holding the tower within the rectangular opening defined therein corresponding to opening 68 described in connection with the base frame.

Also shown in FIG. 1 disposed above the upper frame 26 is stabilizing structure 70 which again comprises a frame or platform which may have the general structural configuration described in connection with frames 24, 26. This stabilizing structure need only be utilized during the climbing operation, and at that time is employed only for imparting lateral stability to the tower, and as a consequence the mass of such structure may be considerably less than the mass of frames or platforms 24, 26.

Further describing the structure illustrated in FIG. 1, depending from upper frame 26 is what is referred to herein as ladder structure 74. The ladder structure comprises a skeletal framework detachably secured to the upper frame as by pins 76 extending through cooperating lug structure presented from the base of the platform and at the top of the ladder structure, respectively. More specifically, the ladder structure includes a pair of opposed sides as exemplified by side 78 shown in FIG. 1 disposed slightly outwardly of opposed sides of the tower or mast. Detachably joined to these opposed sides are another set of sides 80, 82. Opposed sides 78 and opposed sides 80, 82, with the ladder structure assembled as shown in FIG. 1, form an elongate rectangular box encompassing the bottom region of the mast. Each of the sides 86 includes a lower rung 84, a middle rung 86, and an upper rung 88, utilized to provide temporary support for the tower during the climbing operation.

Figure 9:
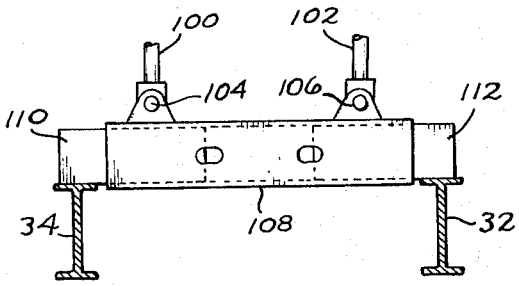
FIG. 9 is a view taken generally along the line 9—9 in FIG. 1.

Referring to FIGS. 1 and 9, suitably rigidly mounted on a bar 90 which is an integral part of the base of tower 14 are cylinders 92 of a pair of fluid-operated ram assemblies 96. Rods 100, 102 of these assemblies are pivotally secured at 104, 106 to a sleeve 108 resembling sleeves 56, 58 earlier described. Sleeve 108, like sleeves 56, 58, has outriggers 110, 112 telescopically received in opposite ends of the sleeve which can be extended to extend beyond the sleeve or retracted to positions wholly within the sleeve. The fluid-operated ram assemblies constitute a power-operated means utilized in elevating the tower crane during the climbing operation.

Explaining now how the structure described is utilized in the climbing of the tower crane to raise it to a new position in the building under construction, prior to climbing, the crane is positioned as shown in, FIG. 1 with the base of tower 14 detachably secured through outriggers 60, 62 to the base frame at the location of floor *a*. Supporting the tower at a location disposed above floor *a*, more specifically, at the location of floor *d*, is upper frame 26. Upper frame 26, with the tower crane in operative position as shown in FIG. 1, provides primarily lateral stability to the tower, with suitable shims provided between the sides of the tower and the opening in the frame corresponding to opening 68 in the base frame, whereby the tower is securely held from lateral movement. Stabilizing frame 70 may be secured to columns 12 above upper frame 26. No shims need be used between the outside of the tower and the opening in this stabilizing frame, since the stabilizing frame need not be relied upon for lateral stability during normal operation of the crane.

Figure 2:
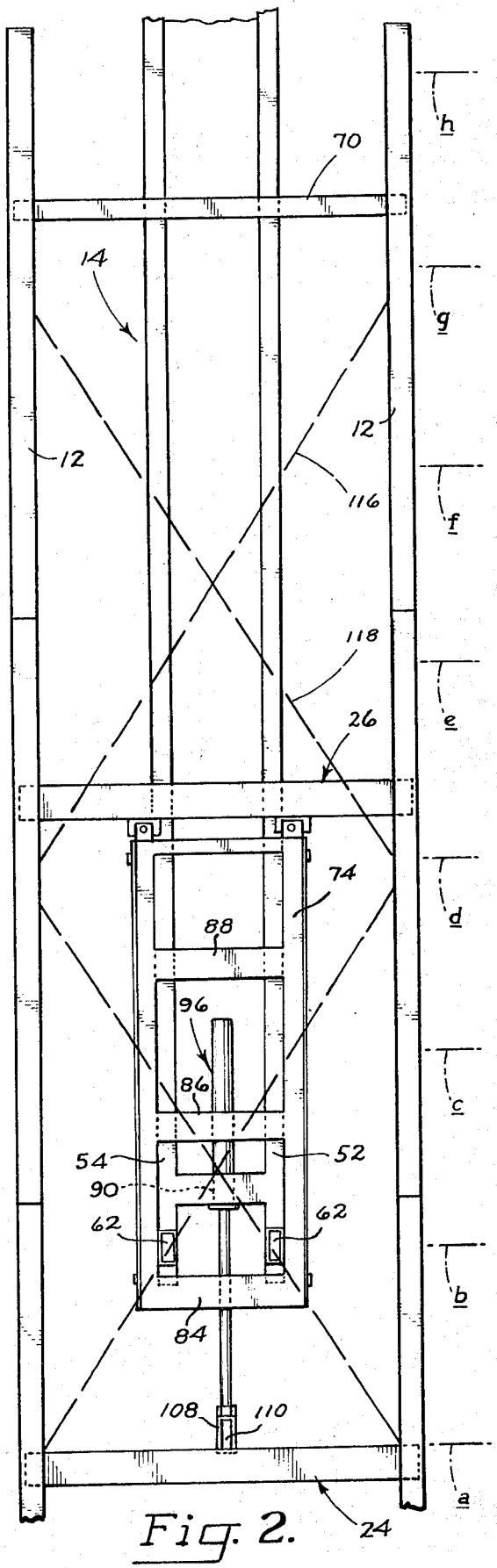
FIG. 2 illustrates the tower crane during a stage in the climbing operation, more specifically, with the tower in the crane shifted upwardly and while working off the base frame preparatory to depositing such on ladder structure depending from an upper frame in the organization.

As construction of the building progresses, additional floors are added to the building, as exemplified by floors *f*, *g* and *h* shown in FIG. 2. It then becomes desirable to jump or elevate the tower crane, to reposition the tower at an elevation which is several floors higher than the elevation occupied in FIG. 1.

At some time prior to jumping or elevating the crane, ladder structure 74 is assembled about the base of tower 14 as illustrated in FIG. 1. Additionally, diagonal guy lines are placed between the various columns, as exemplified by guy lines 116, 118.

As a preliminary to actual jumping of the crane, stabilizing frame 70 is elevated from the position shown in FIG. 1 to the position shown in FIG. 2, which in the embodiment of the invention illustrated is a jump of three floors, to place the stabilizing frame slightly above floor *g*. The stabilizing frame is then secured in place, as by using assemblies such as the pin and bracket plate assemblies 40, 42, 44. The stabilizing frame while accommodating axial displacement of the tower upwardly relative to the frame imparts lateral stability to inhibit the tower from inclining over during the climbing operation. With the stabilizing frame in place, upper frame 26 is elevated to place it slightly above the level of floor *d*, the position which the stabilizing frame formerly occupied.

In elevating the frames, the crane itself may be utilized, with the haul line of the crane secured to a member such as that shown at 120 in FIG. 7 placed under one side of the frame. Haul lines from auxiliary winches secured to brackets 122, 124 shown in FIG. 7 may be utilized to elevate the other side of the frame.

Figure 3:
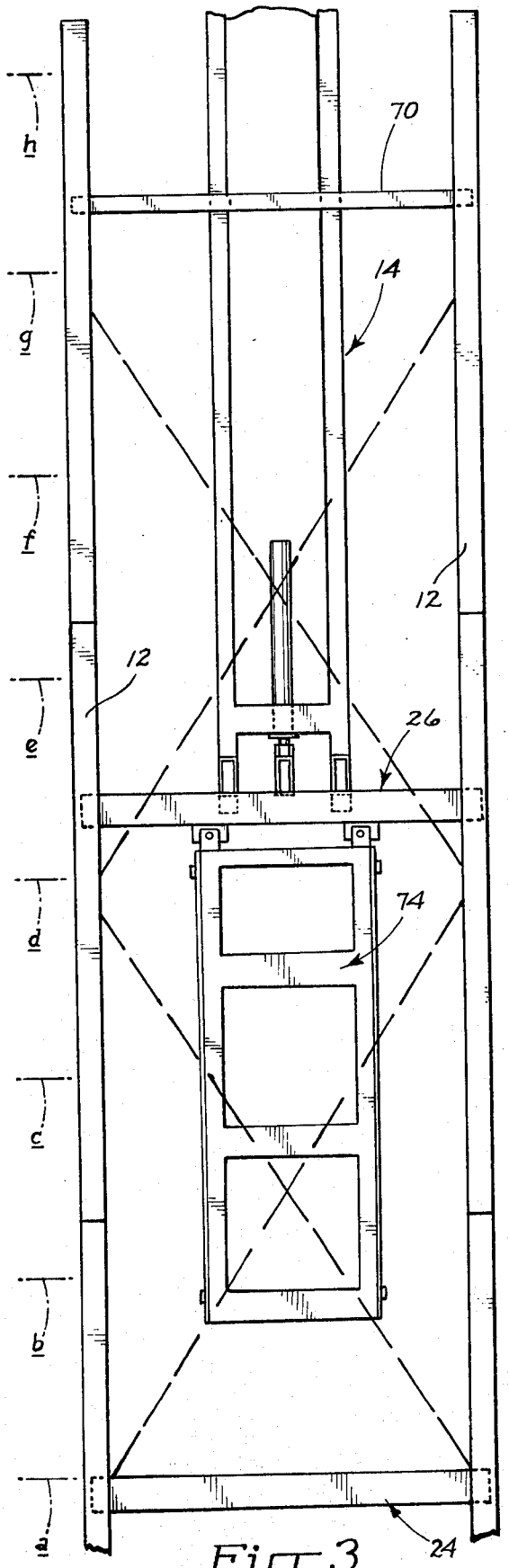
FIG. 3 illustrates a later stage in the climb, with the tower supported on the upper frame and prior to raising the base frame to reposition such in the building under construction.

Outriggers 110, 112 are then extended from sleeve 108 to place them over support beams 32, 34 of the base frame. Outriggers 60, 62 are released from the base frame and retracted into sleeves 56, 58. With extension of ram assemblies 96, the tower is pushed upwardly working off the base frame until the tower assumes the elevation shown in FIG. 2 with outriggers 60, 62 in sleeves 56, 58 located slightly above bottom rungs 84 in the ladder structure. The outriggers are then extended and the tower dropped to rest these outriggers on this set of lower rungs. With subsequent contraction of ram assemblies 96, 98, sleeve 108 may be placed above the lower rungs in the ladder structure, and outriggers 110, 112 extended to place them over the lower rungs. With extension of the ram assemblies and contraction of outriggers 60, 62 in sleeves 56, 58, it is then possible to jump the tower to place its base adjacent rungs 86, and to step the tower upwardly in the same manner as was done in stepping the tower from the base frame to bottom rungs 84. The process is repeated until the base of the tower is made to rest on upper frame 26 as shown in FIG. 3.

With the tower so positioned the stabilizing frame introduces lateral stability and the upper frame is now supporting the weight of the tower and crane.

Figure 4:
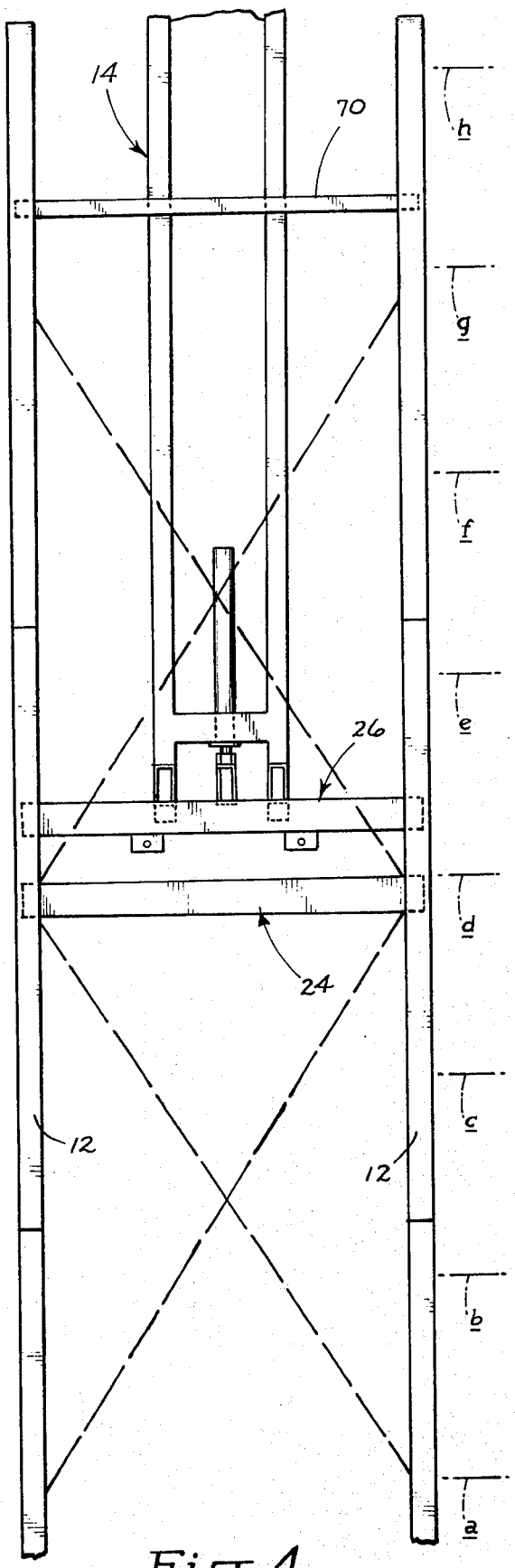
FIG. 4 illustrates the tower crane after removal of a depending ladder structure and raising of the base frame to its new location.
Figure 5:
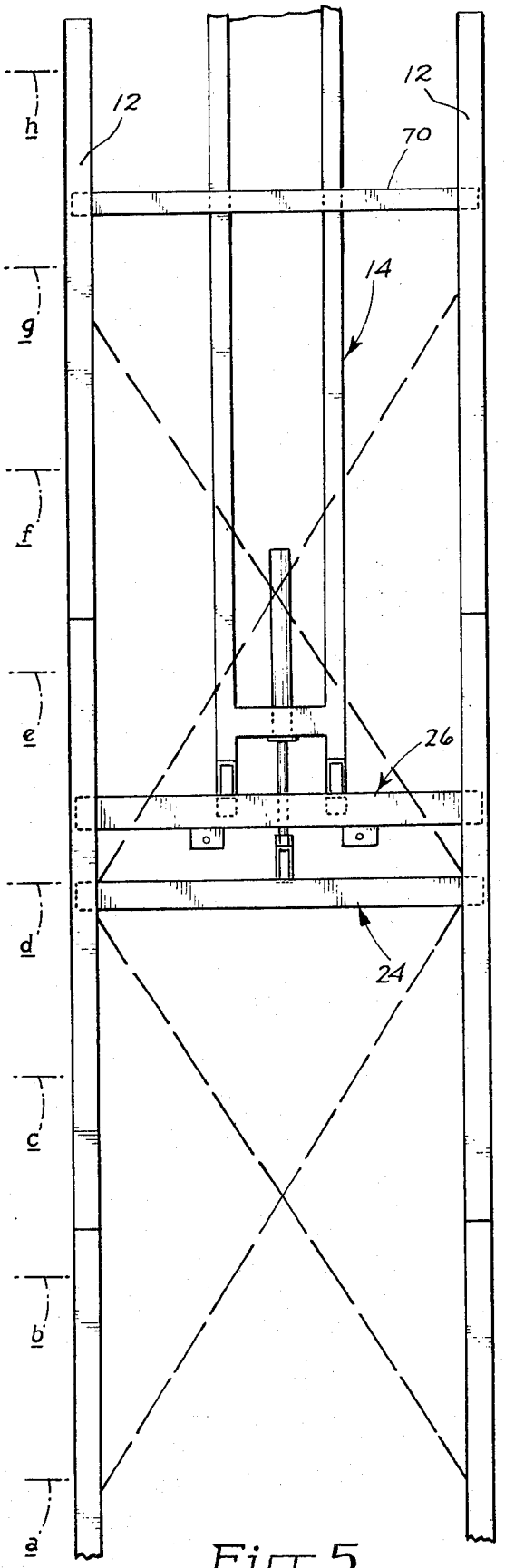
FIG. 5 illustrates the crane tower during the lowering thereof on the newly relocated base frame.

Ladder structure 74 is then removed, and base frame 24 elevated to place it at the level of floor *d* as shown in FIG. 4. This is the floor level originally occupied by upper frame 26. With the base frame so positioned, the tower then may be stepped downwardly, as shown in FIG. 5 to place its base on the lower frame 24. The outriggers at the base of the tower, in an extended, condition, are secured to the base frame.

Figure 6:
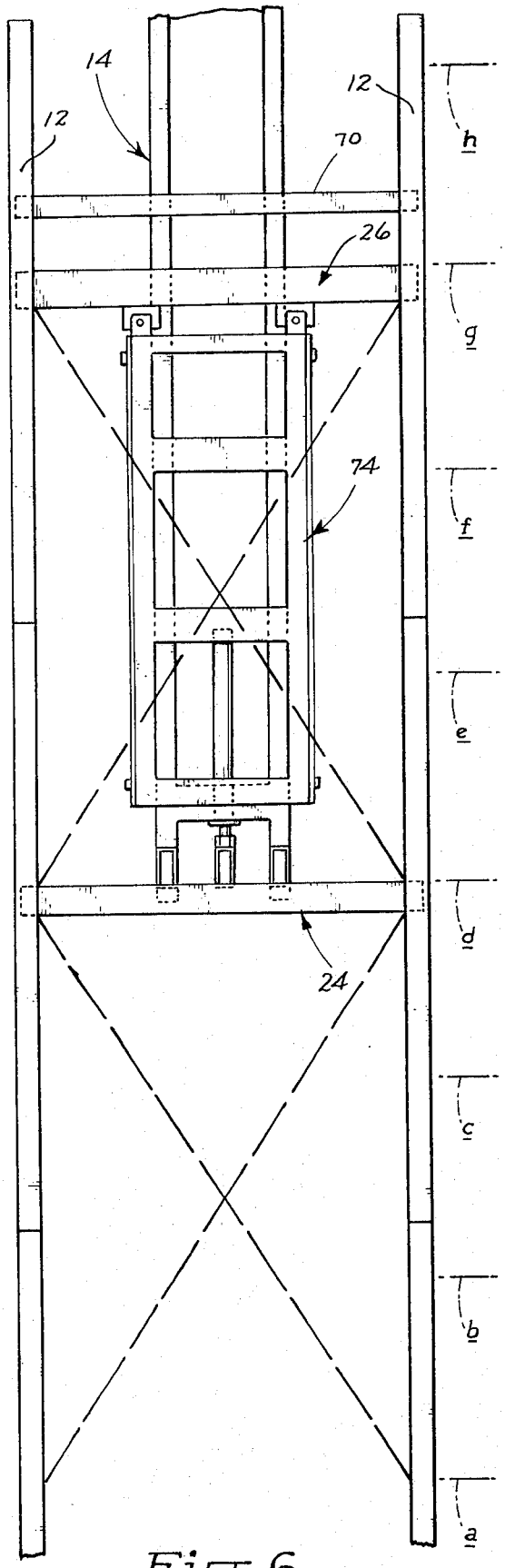
FIG. 6 illustrates the crane repositioned and essentially as shown in FIG. 1 but at a higher elevation.

Raising of upper frame 26 to floor level *g*, with securing of the upper frame at this floor level and reassembly of the ladder structure in its depending position from the upper frame, produces the organization shown in FIG. 6. The tower crane now is in operative condition for load handling, but elevated three floors from the position of the crane before the initiation of the climbing operation as shown in FIG. 1.

It will be noted that the crane as positioned in FIG. 6 again receives its principal support from base frame 24. Lateral stability during load handling and with the crane in operative condition is again rendered by upper frame 26. The climbing operation is performed without disassembly of any of the frames involved.

In the climbing described, the ladder structure is disassembled and removed from the upper frame prior to elevating the base frame 24. As will be apparent from viewing FIG. 7, such removal is accommodated with only slight disassembly of the ladder structure, i.e., removal of one of its sides, since the frames provide ample clearance for the ladder structure to be moved either upwardly or downwardly to be placed in a position at one side of the bay and out of the way.

It is further contemplated, according to the instant invention, that the ladder structure may be left in place throughout the climbing operation. This procedure is possible with construction of the base frame whereby opening 68 (see FIG. 7) is of large enough size to accommodate, not only the mast, but also the ladder structure, with such in place and surrounding the mast or tower as shown in FIG. 1. Utilizing this approach, the outriggers are made with sufficient extension and strength to span the opening at such time as the tower is mounted on the base frame. When climbing is performed in this manner, the base frame is elevated to its position under the upper frame with moving of the base frame upwardly about the outside of the ladder structure.

As the invention has been described, after the crane has performed its working function in lifting the usual construction materials going into the construction of the building, the tower is initially stabilized through upward positioning of frame 70, with frame 26 then being raised and located in position, followed by raising of base frame 24, with the tower then dropped downwardly onto the base frame preparatory to placing the crane in condition for performing work. According to the invention, it is contemplated that in certain applications, working with the crane may be performed at a different stage in the climbing operation than just outlined. More specifically, the crane may be set up in operative condition by first raising and securing in place stabilizing frame 70 and frame 26 as shown in FIG. 2. The tower may then be raised to place its base on frame 26, substantially as shown in FIG. 4. With the base of the tower then secured to frame 26, and with the tower shimmed within frame 70, the crane is supported at its base and stabilized at a point elevated from its base. The crane may then be used in performing the normal work lifting operations. Subsequent climbing of the crane may be performed by lowering the base of the tower on the base frame (after such has been elevated to a position closely adjacent frame 26 as shown in FIG. 5), and then raising frames 70 and 26, with this being followed by elevating the tower to place it again on frame 26. Preferably, frames 26 and 70 would be located at floor levels. As the invention has just been described, frame 26 is utilized to support the base of the crane during working of the crane, and frame 70 is utilized to provide lateral stability for the crane during working of the crane.

It should be noted that during elevating of the crane tower, the weight of the crane and its tower is supported during much of the lifting by frame 26, i.e., the intermediate frame of the three frames or platforms discussed, namely frame 24, frame 26 and frame 70. Of the three frames discussed, frame 70 is the highest, i.e., occupied a position highest in the building under construction. As would be expected, this is the region of the building least adapted for withstanding load, this region of the building tending to be in an incomplete stage of construction. Frame 26, being located well downwardly from frame 70, occupies a region of the building which is more completely constructed, and which is better adapted therefore to withstand the loading to which the frame is subjected when supporting the weight of the tower and crane. Thus, a feature of the invention is that the tower of the crane is moved upwardly in the progress of a climb with the mass of the tower and the crane supported in a region located downwardly from the stabilizing frame.

It should be obvious from the above description that a crane climbing method has been disclosed which is relatively easily performed in a considerably less amount of time than where multiple frames are employed and a leapfrog procedure is used in repositioning a frame. All movements are performed within the confines of the bay. The lifting instrumentality may be relatively simple, as exemplified by the power-operated rams disclosed provided at the base of the tower structure.

While several modifications of the invention have been described, it should be obvious that variations and further modifications are possible without departing from the invention, as would be apparent to one skilled in the art.

It is claimed and desired to secure by Letters patent is:

1. A method of climbing a tower crane having a stationarily positioned base frame adjacent and supporting the base of the tower in the crane and a stationarily positioned upper frame spaced upwardly from the base frame supporting the tower at a location disposed above the base frame, the method comprising providing lateral stabilizing structure for the tower at a location elevated above the location supported by the upper frame, elevating the tower to place its base adjacent the upper frame and then securing the tower to the upper frame, freeing the base frame of its stationary positioning and elevating the base frame to a location more nearly under the upper frame with the base frame then being reestablished in a stationary position, and releasing the tower from the upper frame and then dropping the tower on the base frame.

2. The method of claim 1, which further comprises elevating the upper frame after dropping of the tower whereby it provides support for the tower at a location disposed above the base frame.

3. The method of claim 1, wherein elevating of the tower is performed by climbing the tower on ladder structure depending from the upper frame.

4. The method of claim 3, wherein the base frame is elevated to its position more nearly under the upper frame by moving the base frame upwardly about the outside of the ladder structure.

5. In the construction of a building with floors, a method of climbing a tower crane having a base frame attached thereto which supports the tower in the crane at one floor level, and an upper frame supporting the tower at a location disposed above the floor level of the base frame, the method comprising securing a stabilizing frame to the building whereby such provides lateral support for the tower at a location elevated above said upper frame, freeing the tower from said base frame and elevating the tower to place its base on the upper frame, elevating the base frame to another floor level disposed more nearly under the upper frame and securing said base frame to the building, and dropping the tower on the base frame and securing the base of the tower to said base frame at said other floor level.

6. The method of claim 5, wherein the upper frame is secured initially to the building at a floor level, and before elevating the tower the upper frame is released from the building and secured to the building at a location elevated from this floor level, and said base frame is elevated to the floor level originally occupied by the upper frame where such is secured to the building.

7. The method of claim 6, wherein after dropping of the tower and securing the same to the base frame, the upper frame is elevated to a floor level and secured to the building.

8. The method of claim 7, wherein the stabilizing frame is originally secured to the building above the floor level occupied by the upper frame after the latter has been elevated to a floor level and secured to the building.

9. The method of claim 9, wherein the tower is elevated by climbing the tower on a ladder structure depending from the upper frame.

10. The method of claim 9, wherein the base frame is elevated by moving the same upwardly about the outside of the depending ladder structure.

11. A method of climbing a tower crane which includes a tower and a crane boom supported at the top of the tower, utilizing a base frame, an upper frame, and a stabilizing frame spaced in that order at different elevations disposed upwardly along the length of the tower in the crane, the method comprising repositioning the upper frame and stabilizing frame upwardly in the building with the stabilizing frame as repositioned located above the upper frame, elevating the crane including the tower and boom utilizing the upper frame as repositioned to support the mass of the crane during said elevating, and after elevating the crane securing the base of the tower in place utilizing in said securement said base frame.

12. The method of claim 11, wherein elevating of the crane is done with final positioning of the base of the tower at a location disposed below the level of the upper frame, and the base frame in said securement is below the upper frame.

* * * * *